US011296406B2

(12) United States Patent
Ikematsu

(10) Patent No.: US 11,296,406 B2
(45) Date of Patent: Apr. 5, 2022

(54) ANTENNA DEVICE, ANTENNA CONTROL METHOD, AND PROGRAM

(71) Applicant: Mitsubishi Electric Corporation, Chiyoda-ku (JP)

(72) Inventor: Hiroshi Ikematsu, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 100 days.

(21) Appl. No.: 16/968,715

(22) PCT Filed: Jan. 15, 2019

(86) PCT No.: PCT/JP2019/000932

§ 371 (c)(1),
(2) Date: Aug. 10, 2020

(87) PCT Pub. No.: WO2019/202789

PCT Pub. Date: Oct. 24, 2019

(65) Prior Publication Data

US 2020/0381820 A1 Dec. 3, 2020

(30) Foreign Application Priority Data

Apr. 18, 2018 (JP) ..... JP2018-080179

(51) Int. Cl.
*H01Q 3/08* (2006.01)
*H01Q 3/26* (2006.01)
*H01Q 3/38* (2006.01)

(52) U.S. Cl.
CPC ..... *H01Q 3/08* (2013.01); *H01Q 3/2617* (2013.01); *H01Q 3/2629* (2013.01); *H01Q 3/385* (2013.01)

(58) Field of Classification Search
CPC ..... H01Q 3/08; H01Q 3/2617; H01Q 3/385
See application file for complete search history.

(56) References Cited

U.S. PATENT DOCUMENTS

2007/0034247 A1* 2/2007 Takada ..... H01Q 1/44 136/244
2020/0119444 A1* 4/2020 Cash ..... H01Q 1/288
2020/0259250 A1* 8/2020 Diamond ..... H01Q 1/42

FOREIGN PATENT DOCUMENTS

JP 2002-135019 A 5/2002

OTHER PUBLICATIONS

International Search report dated Mar. 26, 2019 in PCT/JP2019/000932 filed Jan. 15, 2019.

* cited by examiner

*Primary Examiner* — Daniel Munoz
(74) *Attorney, Agent, or Firm* — Oblon, McClelland, Maier & Neustadt, L.L.P.

(57) ABSTRACT

A planar antenna includes a plurality of antenna elements and transmits and receives a radio wave to and from a target. An attitude controller is attached to the planar antenna and controls an attitude of the planar antenna mechanically. An antenna controller controls the attitude controller such that the planar antenna points in a predetermined direction with respect to the target. A scan controller controls beam scanning performed by the planar antenna and adjusts an excitation phase of each of the antenna elements in accordance with a signal level of a reception signal generated from a radio wave received from the target during performance of the beam scanning, thereby directing a beam from the planar antenna toward the target. The scan controller limits a range of the beam scanning to a range within which no grating lobe occurs.

8 Claims, 10 Drawing Sheets

ANTENNA DEVICE, ANTENNA CONTROL METHOD, AND PROGRAM

TECHNICAL FIELD

The present disclosure relates to an antenna device, an antenna control device, and a program.

BACKGROUND ART

An antenna for satellite communications is mounted on an aircraft. Due to change in relative position between the aircraft and a communication satellite, an antenna that has the function for adjusting a pointing direction, such as a mechanically driven antenna, a beam scanning antenna, and a mechanically drivable beam scanning antenna, is mainly used as the antenna for satellite communications mounted on the aircraft. Patent Literature 1 discloses an example of a satellite communication antenna for such an application. The satellite communication antenna disclosed in Patent Literature 1 is a phased array antenna mounted on a moving object and configured to enable scanning of a direction of a beam from the antenna and controlling of an angle of the antenna using multiple actuators.

CITATION LIST

Patent Literature

Patent Literature 1: Unexamined Japanese Patent Application Publication No. 2002-135019

SUMMARY OF INVENTION

Technical Problem

Achievement of high gain, reduction of power consumption, and reduction of cost, for example, are desired for a satellite communication antenna. Thus reducing the number of antenna elements included in the satellite communication antenna is conceivable.

In a case where space utilized by the satellite communication antenna is fixed, reducing the number of antenna elements leads to a widely-spaced arrangement of the antenna elements. However, a phased array antenna with widely-spaced antenna elements may cause a visible region of the antenna to include not only a main beam but also a sub-beam called a grating lobe. Such inclusion of the grating lobe in the visible region of the antenna leads to transmission/reception of a radio wave in a direction other than a direction of the main beam and causes occurrence of electromagnetic interference, thereby causing gain reduction.

Similar problems occur, not only in a case where a phased array antenna is mounted on an aircraft, but also in a case where a satellite communication antenna including a phased array antenna is mounted on another moving object, such as a vehicle and a ship.

The present disclosure is made in view of the above-described circumstances, and the objective of the present disclosure is to provide, while suppressing the number of antenna elements, an antenna device that can perform beam scanning while preventing occurrence of the above-described grating lobe.

Solution to Problem

To achieve the aforementioned objective, the antenna device according to the present disclosure includes a planar antenna, an attitude controller, an antenna controller, and a scan controller. The planar antenna includes a plurality of antenna elements and transmits and receives a radio wave to and from a target. The attitude controller is attached to the planar antenna and controls an attitude of the planar antenna mechanically. The antenna controller controls the attitude controller such that the planar antenna points in a predetermined direction with respect to the target. The scan controller controls beam scanning performed by the planar antenna and adjusts excitation phases of the plurality of antenna elements in accordance with a signal level of a reception signal generated from a radio wave received from the target during performance of the beam scanning, thereby directing a beam from the planar antenna toward the target. The scan controller limits a range of the beam scanning to a range within which no grating lobe occurs. The range within which no grating lobe occurs is determined in accordance with a spacing between the plurality of antenna elements.

Advantageous Effects of Invention

The antenna device according to the present disclosure performs the beam scanning after controlling the attitude of the planar antenna mechanically. The antenna device limits the range of the beam scanning to a range within which no grating lobe occurs, in accordance with the spacing between the plurality of antenna elements. This enables, while suppressing the number of antenna elements, the providing of an antenna device for performing beam scanning while preventing the occurrence of a grating lobe.

DESCRIPTION OF EMBODIMENTS

Figure 1:
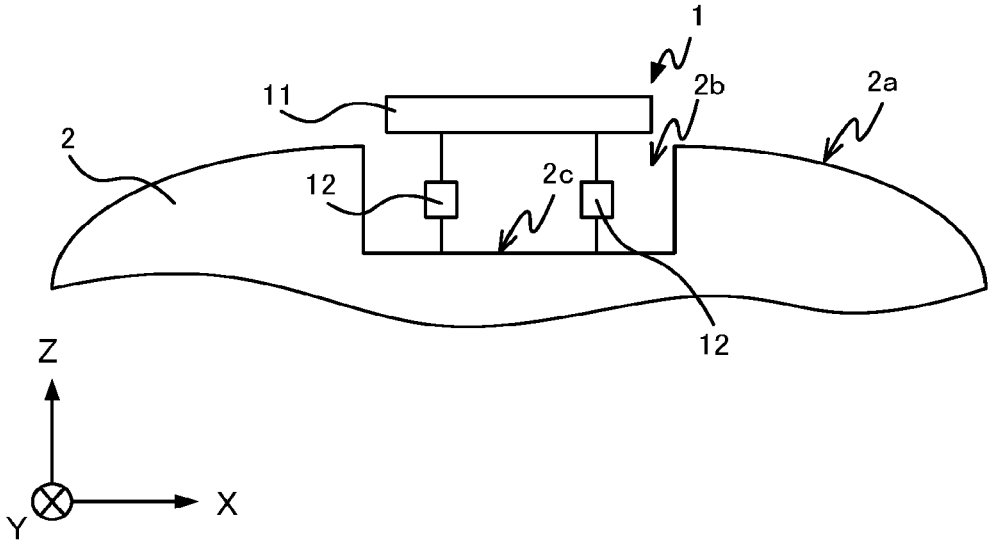
FIG. 1 is a front view of an antenna device according to Embodiment 1 of the present disclosure.

Hereinafter, an antenna device according to an embodiment of the present disclosure is described in detail with reference to the drawings. In the drawings, the same reference signs are given to the same or equivalent parts.

Embodiment 1

An antenna device according to Embodiment 1 is described using, as an example, an antenna device that is mounted on an aircraft as an example of a moving object and communicates with a communication satellite as an example of a target. For easy understanding of descriptions relating to an antenna device 1 illustrated in FIG. 1, an aircraft coordinate system that includes X axis, Y axis, and Z axis is provided and is referred to appropriately. In the aircraft coordinate system, the Y axis indicates a traveling direction of an aircraft 2, the Z axis indicates a direction orthogonal to a bottom face of the aircraft, and the X axis is orthogonal to the Y axis and the Z axis. The bottom face of the aircraft is a surface that is horizontal when the aircraft is at rest on level ground. FIG. 1 illustrates the antenna device 1 as viewed from the rear in the traveling direction of the aircraft 2 to the front in the traveling direction.

Figure 2:
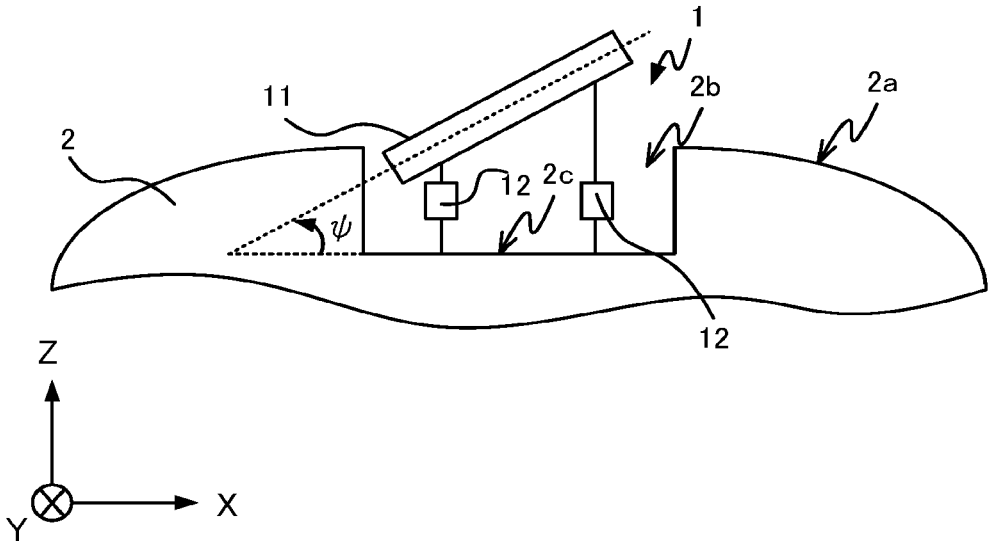
FIG. 2 is a front view of the antenna device according to Embodiment 1.

The antenna device 1 is disposed in a concave portion 2*b* formed in an outer surface 2*a* of the aircraft 2. As each of the aircraft 2 and the communication satellite moves, a position of the communication satellite viewed from the aircraft 2 changes. Thus the antenna device 1 performs beam scanning and control of the beam to direct the beam toward the communication satellite and communicates with the communication satellite. The antenna device 1 includes a beam scanning-type planar antenna 11 that transmits and receives a radio wave to and from the communication satellite. An attitude controller 12 is attached to the planar antenna 11. The attitude controller 12 is fixed to a bottom face 2*c* of the concave portion 2*b*. Specifically, the attitude controller 12 includes at least three support portions that support the planar antenna 11 in the direction of the Z axis. Adjusting lengths of the support portions in the Z-axis direction enables, as illustrated in FIG. 2, causing the planar antenna 11 to tilt in a desired direction and at a desired angle with respect to the bottom face 2*c*. In FIG. 2, the planar antenna 11 tilts counterclockwise from the bottom face 2*c* by an angle $\psi$. The bottom face 2*c* is a surface that is horizontal when the aircraft is at rest on level ground.

Figure 3:
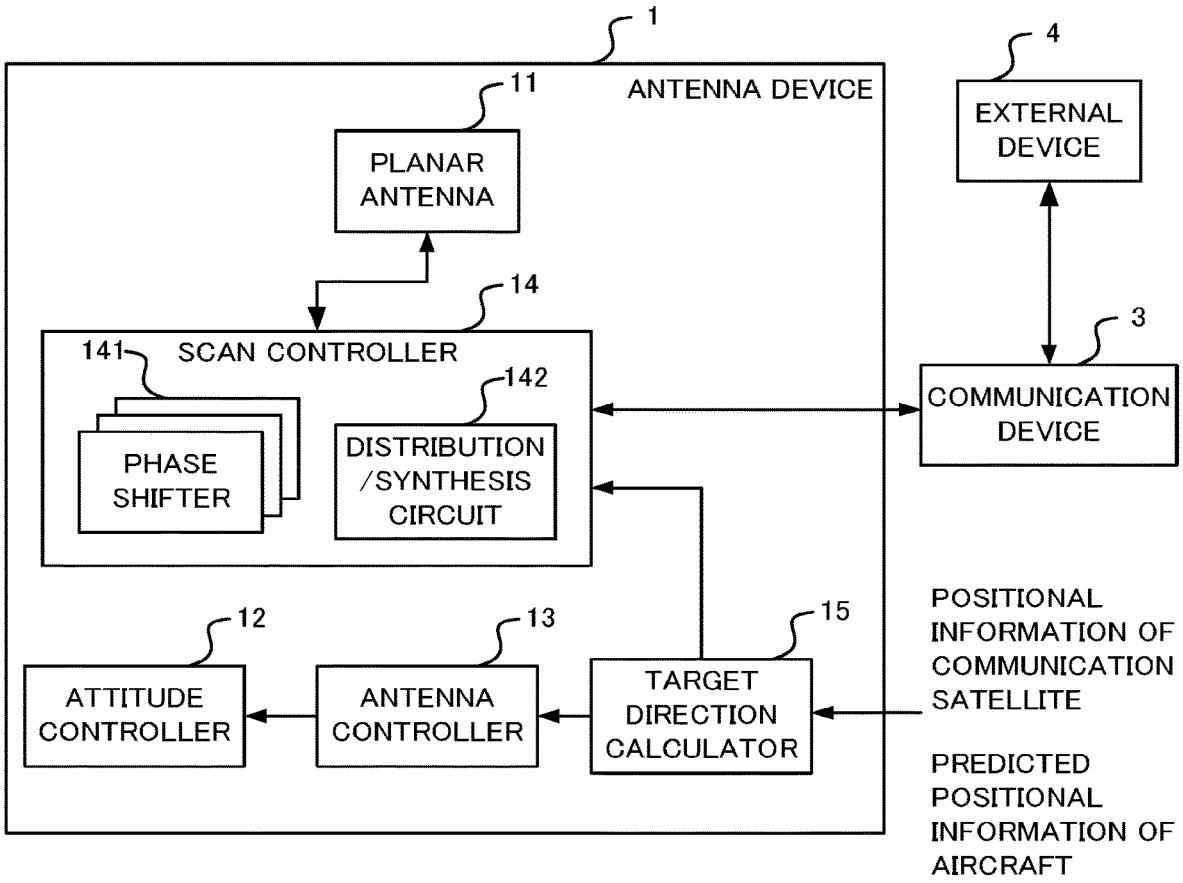
FIG. 3 is a block diagram illustrating a configuration of the antenna device according to Embodiment 1.

As illustrated in FIG. 3, the antenna device 1 generates a reception signal from a radio wave received from the communication satellite, and transmits the reception signal to a communication device 3. The communication device 3 includes, for example, an amplifier, a filter and a mixer, generates a desired signal by processing the reception signal, and outputs the signal to an external device 4. Additionally, the communication device 3 generates a transmission signal by processing a signal acquired from the external device 4 and outputs the transmission signal to the antenna device 1. The antenna device 1 transmits a radio wave generated from the transmission signal.

As illustrated in FIG. 3, the antenna device 1 electrically includes, in addition to the planar antenna 11 and the attitude controller 12 that are described above, an antenna controller 13 that controls the attitude controller 12, a scan controller 14 that directs the beam from the planar antenna 11 toward the communication satellite, and a target direction calculator 15 that calculates a direction of the communication satellite.

The antenna controller 13, the scan controller 14, and the target direction calculator 15 are housed inside the aircraft 2. The antenna controller 13 controls the attitude controller 12 such that the planar antenna 11 points in the direction of the communication satellite that is calculated by the target direction calculator 15. In other words, the antenna controller 13 controls the attitude controller 12 to cause the planar antenna 11 to point in the direction of the communication satellite. The scan controller 14 controls the beam scanning performed by the planar antenna 11. Further, the scan controller 14 adjusts excitation phases of antenna elements of the planar antenna 11 in accordance with a signal level of a reception signal generated during performance of the beam scanning, thereby directing the beam from the planar antenna 11 toward the communication satellite. The scan controller 14 limits the range of the beam scanning to a range within which a grating lobe that is described later does not occur. Hereinafter, various elements included in the antenna device 1 are described in detail.

Figure 4:
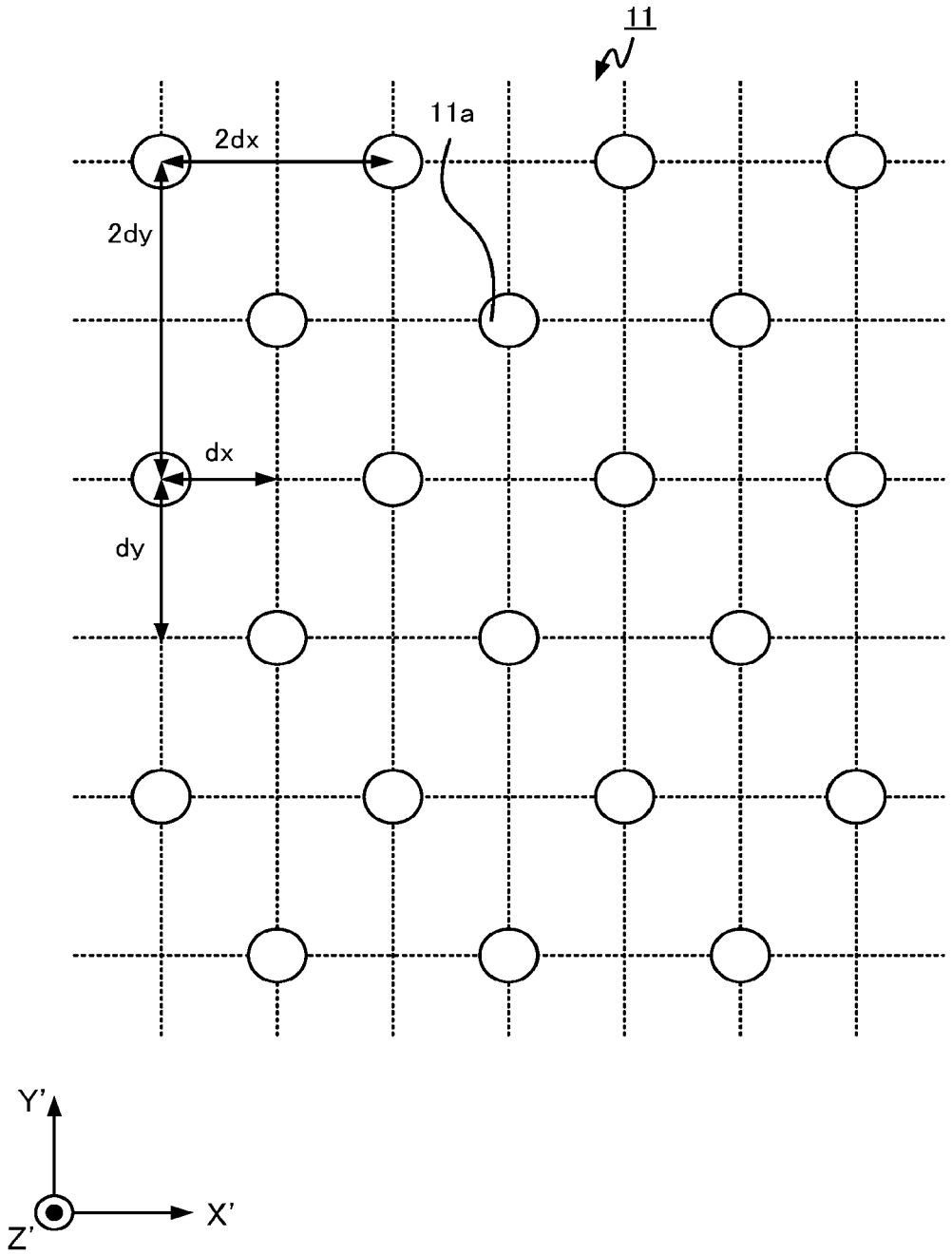
FIG. 4 illustrates an example arrangement of antenna elements according to Embodiment 1.

As illustrated in FIG. 4, the planar antenna 11 includes a phased array antenna including a plurality of antenna elements 11*a*. Each of the plurality of antenna elements 11*a* of the planar antenna 11 is a linear antenna, a slot antenna, a microstrip antenna, or the like. The antenna elements 11*a* are arranged in a triangular pattern on the main surface of the planar antenna 11. The coordinate system illustrated in FIG. 4 is an antenna coordinate system that is rotatable in accordance with a tilt of the planar antenna 11 with respect to the horizontal surface. The Z' axis is defined as an axis orthogonal to an antenna face on which the antenna elements 11*a* are arranged. The X' axis and the Y' axis are defined as array directions of the antenna elements 11*a*. The X' axis and the Y' axis are orthogonal to each other and are orthogonal to the Z' axis. The antenna elements 11*a* are arranged with a spacing of 2*dx* in the X'-axis direction and a spacing of 2*dy* in the Y'-axis direction. Further, from each of the antenna elements 11*a* arranged as described above, antenna elements 11*a* are arranged with a spacing of dx in the X'-axis direction and a spacing of dy in the Y'-axis direction.

Figure 5:
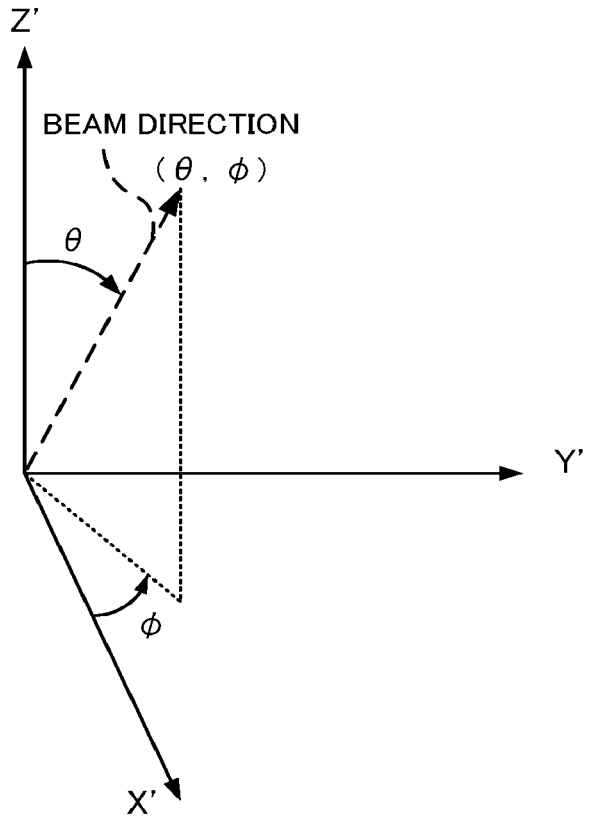
FIG. 5 illustrates scanning angles in Embodiment 1.

A beam direction of the planar antenna 11 is expressed by scanning angles ($\theta$, $\varphi$), as illustrated in FIG. 5. The angle $\theta$ is an angle between the beam direction and the Z' axis. The angle $\varphi$ is an angle between the X' axis and a plane containing the beam direction and the Z' axis. An angle between the Y' axis and the plane containing the beam direction and the Z' axis is expressed by ($90°-\varphi$). In the planar antenna 11, an allowable range of the scanning angle $\theta$ is $-\pi/2 \leq \theta \leq \pi/2$. This range is called a visible region. The gain of the antenna pattern increases cyclically, and a peak value called a grating lobe exists in addition to the main beam.

The attitude controller 12 is attached between the back surface of the planar antenna 11 and the bottom face 2*c* as described above, and controls an attitude of the planar antenna 11 mechanically. The antenna controller 13 controls the attitude controller 12 to cause the planar antenna 11 to point in a predetermined direction with respect to the communication satellite. In the present embodiment, the antenna controller 13 acquires, from the target direction calculator 15 described later, a direction of the communication satellite as viewed from the aircraft 2 and controls the attitude controller 12 to extend the Z' axis in the direction of the communication satellite, thereby extending the Z' axis in the direction of the communication satellite.

The scan controller 14 includes phase shifters 141 each provided for the corresponding antenna element 11*a* and a distribution/synthesis circuit 142. The distribution/synthesis circuit 142 synthesizes the radio waves received by the antenna elements 11*a*, thereby generating the reception signal. The scan controller 14 transmits the reception signal to the communication device 3. Additionally, the scan controller 14 acquires the transmission signal from the communication device 3. The transmission signal is distributed by the distribution/synthesis circuit 142 and output to each phase shifter 141. The scan controller 14 uses each phase shifter 141 to adjust the corresponding excitation phase, thereby controlling the beam direction of the planar antenna 11.

The scan controller 14 acquires, from the target direction calculator 15 described later, the direction of the communication satellite as viewed from the aircraft 2. Then the scan controller 14 controls, based on the direction of the communication satellite as viewed from the aircraft 2, the beam scanning performed by the planar antenna 11. Further, the scan controller 14, in accordance with a signal level of the reception signal that is generated from the radio wave received from the communication satellite during performance of beam scanning, using a step track system, searches for a direction at which the signal level becomes the highest, that is to say, a direction of the communication satellite. When the direction of the communication satellite is searched out, the scan controller 14 adjusts the excitation phases of the antenna elements 11*a* to direct the beam from the planar antenna 11 toward the communication satellite.

Figure 6:
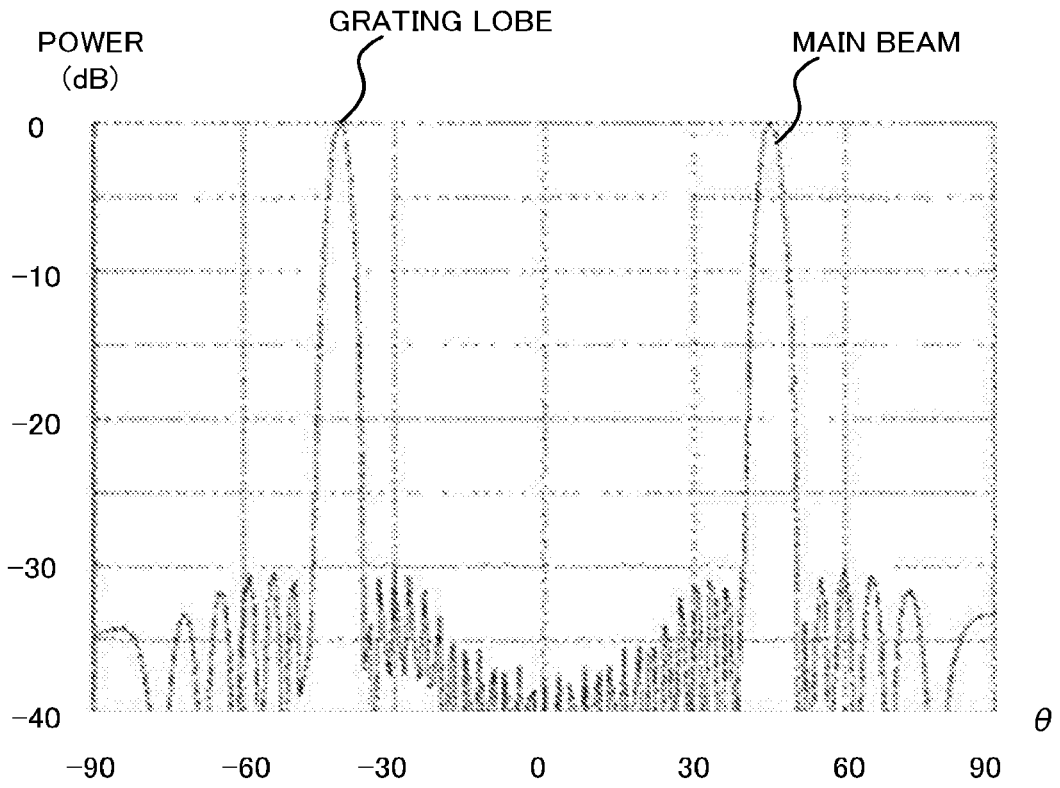
FIG. 6 illustrates an example main beam and an example grating lobe in Embodiment 1.
Figure 7:
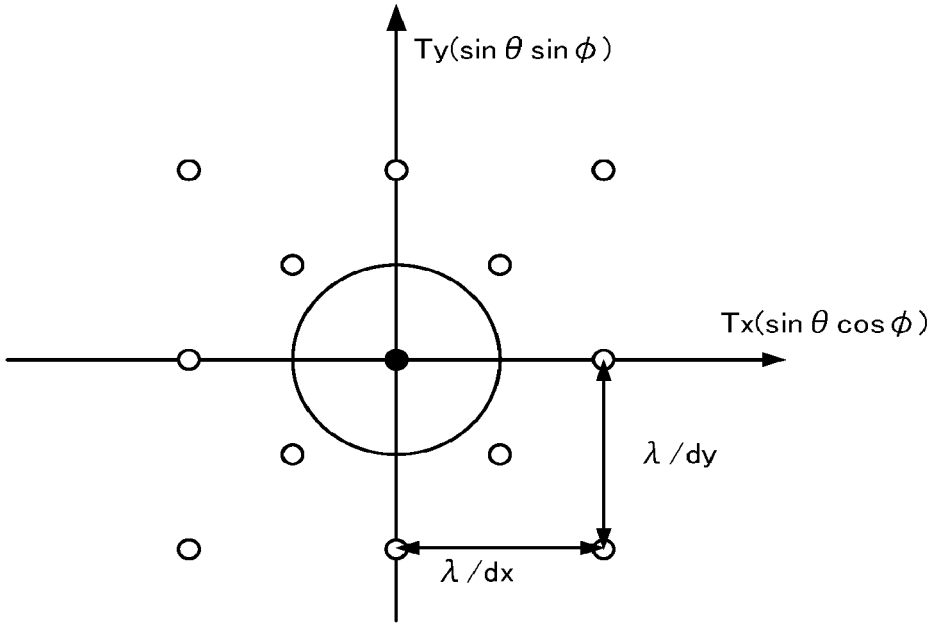
FIG. 7 illustrates positions of grating lobes with respect to a visible region in Embodiment 1.

A widely-spaced arrangement of the antenna elements 11*a* may lead to inclusion in the visible region of the planar antenna 11 of, not only a main beam including a gain peak but also a grating lobe. FIG. 6 illustrates an example of the main beam and the grating lobe. In the example illustrated in FIG. 6, whereas a main beam exists in the direction of 45°, a grating lobe having a gain peak comparable to the main beam exists in the direction of −45°. FIG. 7 is a grating lobe diagram illustrating positions of grating lobes with respect to the visible region. In FIG. 7, the Tx axis indicates sin θ cos φ, and the Ty axis indicates sin θ sin φ. The visible region is expressed by a circle of radius 1 centered at the origin. In FIG. 7, the filled circle indicates a direction of the target (that is, the direction of arrival of the radio wave), and the open circles indicate the grating lobes. FIG. 7 illustrates a case where the target is located in the direction determined by the coordinates θ=0° and φ=0°. In this case, no grating lobe exists in the visible region, and thus no grating lobe occurs.

Figure 8:
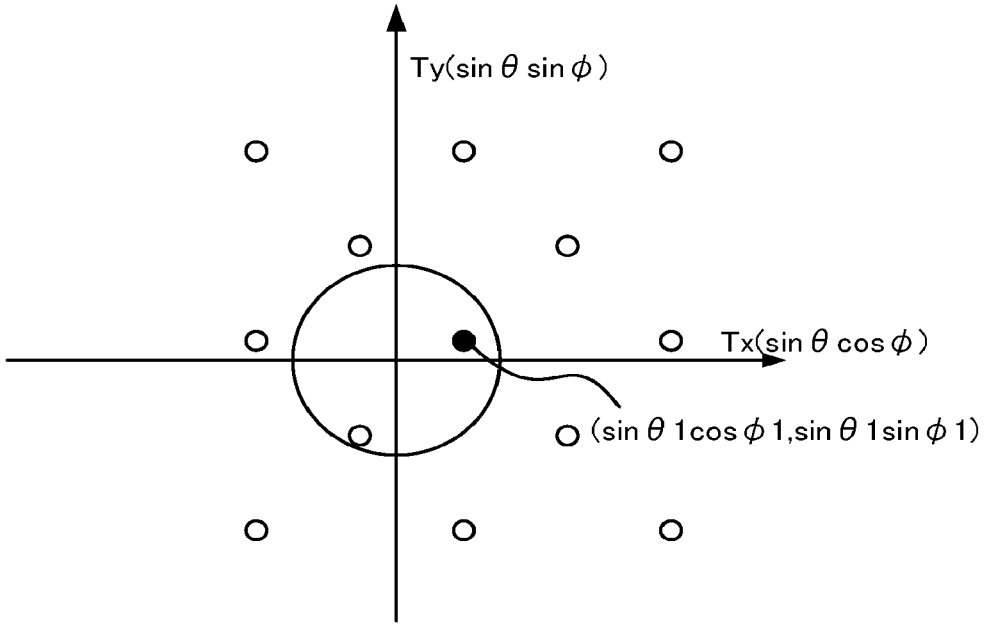
FIG. 8 illustrates positions of grating lobes with respect to the visible region in Embodiment 1.

FIG. 8 illustrates a case where the target is located in the direction determined by the coordinates θ=θ1 and φ=φ1. The grating lobes are, in accordance with the position of the target, translated from the state of θ=0° and φ=0° in parallel on the grating lobe diagram. This leads to inclusion of the grating lobe in the visible region, that is to say, occurrence of the grating lobe. As illustrated in FIGS. 7 and 8, a spacing between the grating lobes of the grating lobe diagram is expressed by a value obtained by dividing a free space wavelength λ by the dx illustrated in FIG. 4, or by a value obtained by dividing the free space wavelength λ, by the dy illustrated in FIG. 4. The grating lobes on the grating lobe diagram become more closely-spaced when the antenna elements 11*a* are provided with a widely-spaced arrangement, that is, when the values of dx and dy are large. This leads to a smaller range of the scanning angles within which no grating lobe occurs.

As described above, whether a grating lobe occurs depends on the spacing between the antenna elements 11*a*. In other words, the range of the scanning angle θ and the range of the scanning angle φ within which no grating lobe occurs are predetermined in accordance with the spacing between the antenna elements 11*a*. Thus the scan controller 14 limits the beam scanning performed by the planar antenna 11 to a range within which no grating lobe is included in the visible region, that is to say, to a range within which no grating lobe occurs, which is determined by a combination of θ and φ. Specifically, the scan controller 14 performs the beam scanning while limiting each of the scanning angle θ and the scanning angle φ of the planar antenna 11 to a range of a maximum scanning angle $\theta_{LMT}$ and a maximum scanning angle $\varphi_{LMT}$ that are defined by dx and dy as the spacings between the antenna elements 11*a*. The scan controller 14 holds in advance $\theta_{LMT}$ as the maximum scanning angle of θ and $\varphi_{LMT}$ as the maximum scanning angle of φ. Here, $\theta_{LMT}$ and $\varphi_{LMT}$ can be determined at the design stage of the planar antenna 11. The scan controller 14 performs the beam scanning while maintaining the scanning angles of the planar antenna 11 within the range of $-\theta_{LMT} \leq \theta \leq \theta_{LMT}$ and the range of $-\varphi_{LMT} \leq \varphi \leq \varphi_{LMT}$.

To perform the above-described processing, the scan controller 14 includes a determination circuit that determines whether the scanning angle θ is within the range of $-\theta_{LMT} \leq \theta \leq \theta_{LMT}$ and whether the scanning angle φ is within the range of $-\varphi_{LMT} \leq \varphi \leq \varphi_{LMT}$. Further, the scan controller 14 includes a wave stop controller that stops transmission of the radio wave when the determination circuit determines that the scanning angle θ is not within the range of $-\theta_{LMT} \leq \theta \leq \theta_{LMT}$ or that the scanning angle φ is not within the range of $-\varphi_{LMT} \leq \varphi \leq \varphi_{LMT}$. When the Z' axis is directed toward the communication satellite after the control performed by the antenna controller 13, searching for the direction at which the signal level of the reception signal becomes the highest can be achieved by performing the beam scanning while adjusting only one of the scanning angles θ and φ.

The target direction calculator 15 acquires, from an inertial navigation device that is a non-illustrated external device, positional information of the communication satellite and predicted positional information of the aircraft 2. Then the target direction calculator 15 calculates, based on the positional information of the communication satellite and the predicted positional information of the aircraft 2, the direction of the communication satellite as viewed from the aircraft 2. The positional information of the communication satellite includes a latitude, a longitude, and an altitude of the communication satellite. The positional information of the aircraft 2 includes a latitude, a longitude, and an altitude of the aircraft 2.

The antenna device 1 having the above-described configuration directs the Z' axis toward the communication satellite and performs the beam scanning while maintaining the range of the beam scanning performed by the planar antenna 11 within the range within which no grating lobe occurs. Operation of the antenna device 1 is described with reference to FIG. 9. The target direction calculator 15 calculates at fixed time intervals the direction of the communication satellite as viewed from the aircraft 2 (step S11). Specifically, the target direction calculator 15 calculates the direction of the communication satellite as viewed from the aircraft 2, based on the positional information of the communication satellite and the predicted positional information of the aircraft 2. Then the target direction calculator 15 transmits the calculated direction of the communication satellite to the antenna controller 13 and to the scan controller 14. The direction of the communication satellite is expressed by an azimuth angle and an elevation angle.

The antenna controller 13, after acquiring from the target direction calculator 15 the direction of the communication satellite as viewed from the aircraft 2, controls the attitude controller 12 to direct the Z' axis toward the communication satellite in accordance with the direction of the communication satellite (step S12). Specifically, the antenna controller 13 adjusts the lengths in the Z-axis direction of the support portions included in the attitude controller 12 to tilt the planar antenna 11, thereby directing the Z' axis toward the communication satellite.

The scan controller 14 acquires, from the communication device 3, information indicating the signal level of the reception signal. The scan controller 14 performs the beam scanning while changing the beam direction of the planar antenna 11 to search for the direction at which the signal level of the reception signal that is received during performance of beam scanning becomes the highest (step S13) The scan controller 14 limits the range of the beam scanning to a range within which no grating robe occurs. When the direction at which the signal level becomes the highest (that is, the direction of the communication satellite) is searched out by performing the processing in step S13, the scan controller 14 directs the beam toward the direction of the searched-out communication satellite, thereby communicating with the communication satellite (step S14). When the signal level of the reception signal decreases, for example, to equal to or lower than a threshold level in step S14, the processing returns to step S11 and the processing described above is repeatedly performed.

Figure 10:
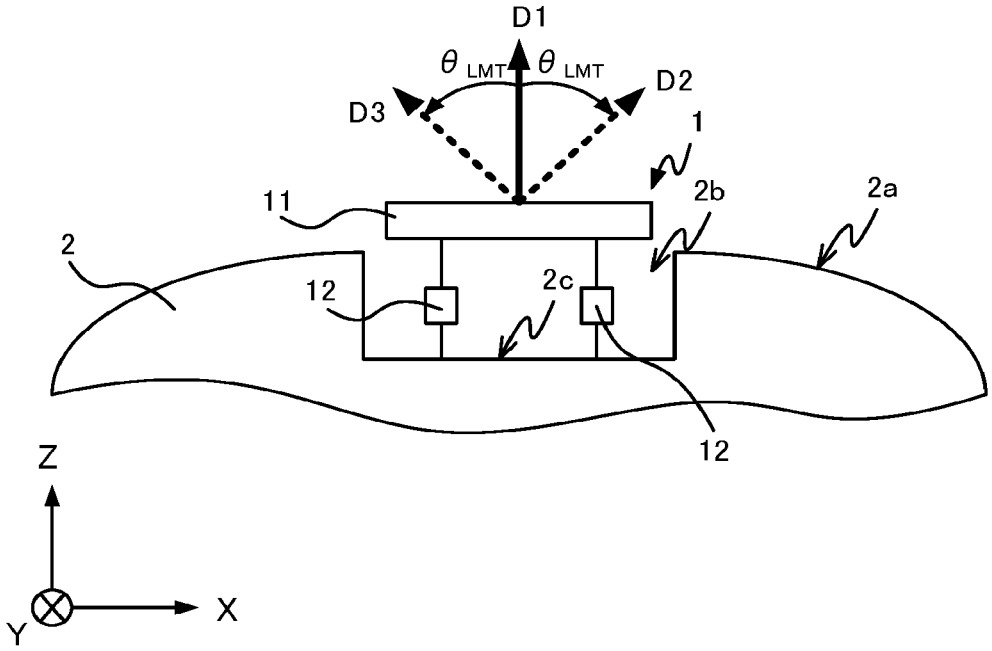
FIG. 10 is a front view of the antenna device according to Embodiment 1.
Figure 11:
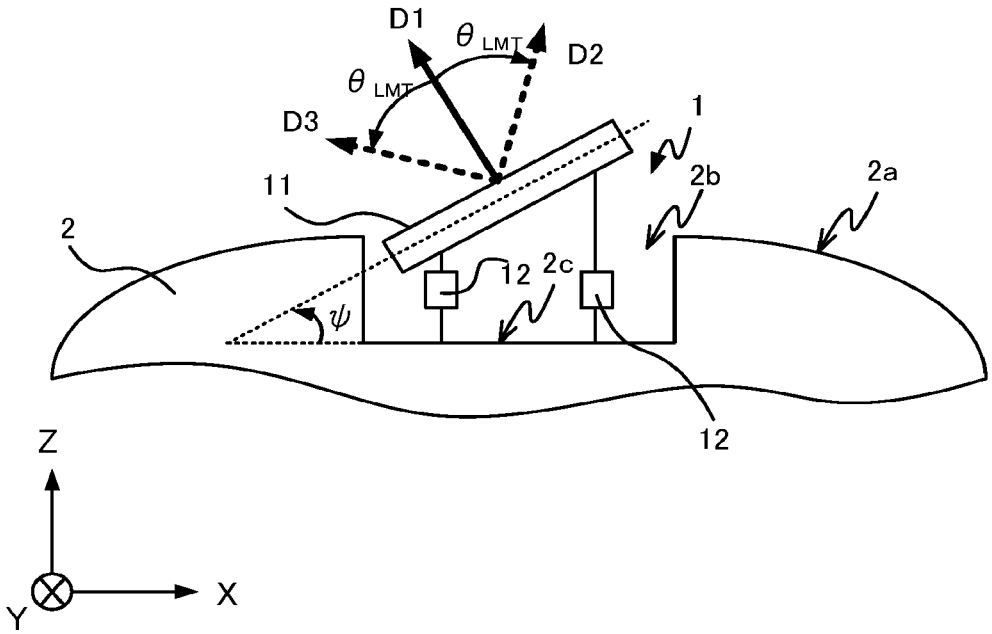
FIG. 11 is a front view of the antenna device according to Embodiment 1.

The scan controller 14, after the attitude controller 12 controlled by the antenna controller 13 controls the attitude of the planar antenna 11 mechanically, performs the beam scanning while maintaining the scanning angle θ of the planar antenna 11 within the range within which no grating lobe occurs, thereby preventing the occurrence of grating lobes. FIG. 10 and FIG. 11 correspond respectively to FIG. 1 and FIG. 2 and are obtained by appending the beam directions to FIGS. 1 and 2. For easy understanding, a case of keeping the scanning angle φ constant and adjusting only the scanning angle θ is described as an example. The solid arrow indicates a beam direction D1 when the scanning angle θ is zero. The dashed arrows indicate a beam direction D2 when the scanning angle θ is $\theta_{LMT}$ and a beam direction D3 when the scanning angle θ is In employing an antenna device that does not control the attitude of the planar antenna 11 mechanically, that is, in a case where the orientation of the planar antenna 11 does not change from the state illustrated in FIG. 10, performing the beam scanning while avoiding occurrence of a grating lobe can be achieved only when the beam scanning is performed within the range between D2 and D3 in FIG. 10. In employing the antenna device 1 according to Embodiment 1, the beam scanning is performed within the range of $-\theta_{LMT} \leq \theta \leq \theta_{LMT}$ after the planar antenna 11 is tilted with respect to the horizontal plane, as illustrated in FIG. 11. Although FIG. 11 illustrates a case where the planar antenna 11 is tilted counterclockwise around the Y axis, the planar antenna 11 may be tilted clockwise around the Y axis. The antenna device 1 according to Embodiment 1 can perform the beam scanning while avoiding occurrence of a grating lobe in a wider range, that is, in the range obtained by combining the scanning range in a case where the planar antenna 11 is tilted counterclockwise around the Y axis and the scanning range in a case where the planar antenna 11 is tilted clockwise around the Y axis. Further, as illustrated in FIG. 11, a portion of the planar antenna 11 is located inside the concave portion 2*b* when tilting the planar antenna 11 with respect to the bottom face 2*c*. This can reduce the influence of the planar antenna 11 on aerodynamic characteristics of the aircraft 2.

As described above, the antenna device 1 according to Embodiment 1 controls the attitude of the planar antenna 11 mechanically, thereby enabling limiting the range of the beam scanning to a range within which no grating lobe occurs. This prevents the occurrence of a grating lobe. Preventing the occurrence of a grating lobe allows a widely-spaced arrangement of the antenna elements 11*a*. Furthermore, the beam scanning is performed after the antenna controller 13 controls the attitude of the planar antenna 11 mechanically. This allows performance of the beam scanning in a region nearer the horizontal plane while preventing the occurrence of a grating lobe. In a planar antenna whose attitude is not controlled mechanically, the antenna aperture viewed from the beam direction becomes smaller as the absolute value of the scanning angle θ approaches π/2. This leads to a larger half-power beam width and decreasing of gain, and accordingly, such a planar antenna is required to be large to enable communications. Conversely, the antenna device 1 according to Embodiment 1 controls the attitude of the planar antenna 11 mechanically to direct the Z' axis toward the target, and thus the planar antenna 11 can be miniaturized.

Embodiment 2

Figure 12:
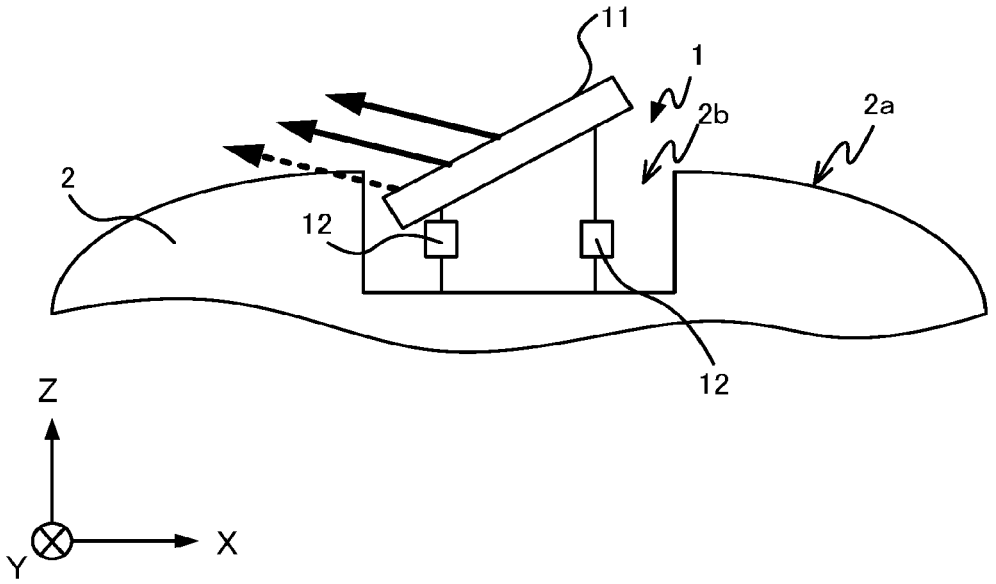
FIG. 12 is a front view of an antenna device according to Embodiment 2 of the present disclosure.

When the antenna controller 13 controls the attitude of the planar antenna 11 mechanically as described in Embodiment 1, the beams from some of the antenna elements 11*a* are radiated toward the communication satellite as illustrated in FIG. 12 using the solid arrows, but the beams from the other antenna elements 11*a* may be blocked by the edge of the concave portion 2*b* as illustrated using the dashed arrow.

Thus in the antenna device 1 according to Embodiment 2, the antenna controller 13 controls the attitude of the planar antenna 11 mechanically in a range within which blocking of the beam by the edge of the concave portion 2*b* does not occur. Specifically, the antenna controller 13 controls the attitude controller 12 to radiate the beams from the plurality of antenna elements 11*a* to the exterior of the aircraft 2 such that the beams pass through positions located away from the edge of the concave portion 2*b*. The range within which the blocking does not occur is defined based on a rotatable range of the planar antenna 11 around the X axis and a rotatable range of the planar antenna 11 around the Y axis, and is also determined based on a shape and size of the concave portion 2*b* and a position of the planar antenna 11 in the concave portion 2*b*. The antenna controller 13 holds the range within which the blocking does not occur. The antenna controller 13 controls, in the range within which the blocking does not occur, the attitude controller 12 to direct the Z' axis toward the communication satellite.

Figure 13:
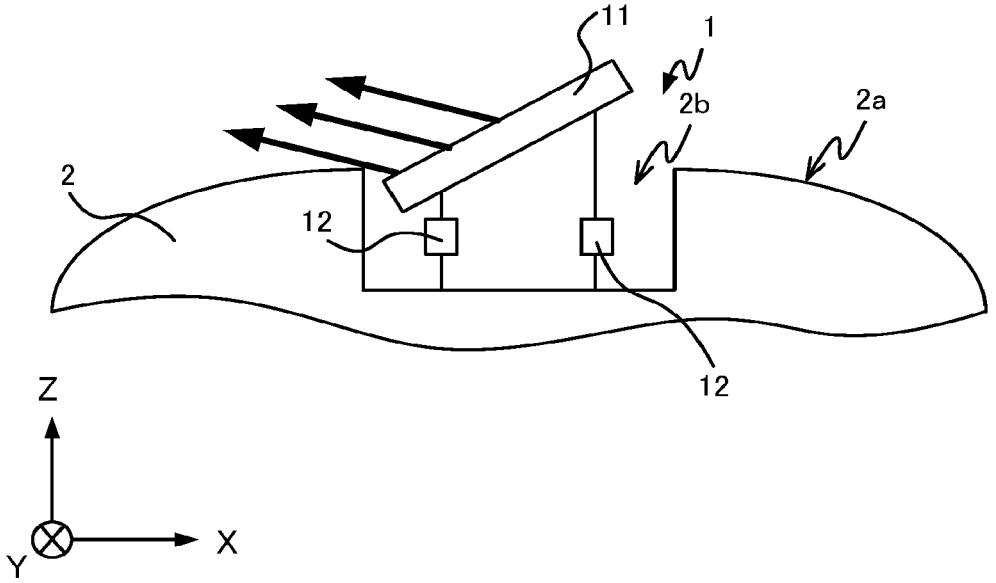
FIG. 13 is a front view of the antenna device according to Embodiment 2.

Moving a lower end of the planar antenna 11 in the Z-axis direction above the position thereof in FIG. 12 prevents any beam from the antenna elements 11*a* from being blocked by the edge of the concave portion 2*b*, as illustrated in FIG. 13.

As described above, the antenna device 1 according to Embodiment 2 can prevent the beams from the plurality of antenna elements 11*a* from being blocked by the edge of the concave portion 2*b*.

Figure 14:
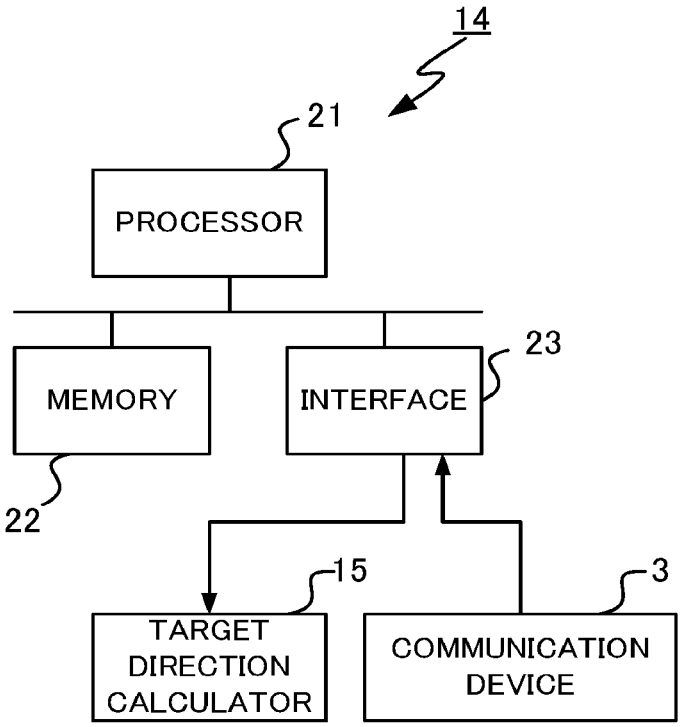
FIG. 14 illustrates a hardware configuration of a scan controller according to the embodiments.

FIG. 14 illustrates an example hardware configuration of a scan controller 14 according to the embodiments. The scan controller 14 includes, as hardware components to control each element, a processor 21, a memory 22, and an interface 23. The processor 21 executes a program stored in the memory 22, thereby achieving the functions of these elements. Further, the scan controller 14 stores the maximum scanning angles $\theta_{LMT}$ and $\varphi_{LMT}$ in the memory 22. The interface 23 is used for connecting devices to each other and establishing communications, and may include several kinds of interfaces, as may be required. The scan controller 14 is connected to the target direction calculator 15 and the communication device 3 via the interface 23, to perform communications. Although FIG. 14 illustrates a case of employing one processor 21 and one memory 22, the functions may be achieved by cooperation of multiple processors 21 and multiple memories 22.

Furthermore, the above-described hardware configuration and flowchart are merely examples, and maybe changed and modified freely.

A portion that includes the processor 21, the memory 22, and the interface 23 and serves as a central part for executing control processing is not limited to a dedicated system and may be achieved by a general computer system. For example, the scan controller 14 for executing the above-described processing can be achieved by storing a computer program to execute the above-described operation in a computer-readable recording medium, distributing the computer-readable recording medium, and installing the computer program in a computer. Examples of such a recording medium are a flexible disk, a compact disc read-only memory (CD-ROM), and a digital versatile disc read-only memory (DVD-ROM). Furthermore, the computer program may be stored in a storage device included in a server device on a communication network and may be downloaded onto a general computer system, to achieve the scan controller 14.

Furthermore, in the case where the functions of the scan controller 14 are implemented by an operating system (OS) and an application program by allocation to the OS and the application program or are implemented by cooperation between the OS and the application program for example, storing in the recording medium and the storage device of only portions of the application program is permissible.

Furthermore, the computer program may be distributed via a communication network by superimposing the computer program on a carrier wave. For example, the computer program may be distributed via a communication network by posting the computer program on a bulletin board system (BBS) on a communication network. Furthermore, the above-described processing may be performed by starting and executing the computer program in the same manner as other application programs under the control of an OS.

Although embodiments of the present disclosure are descried above, the present disclosure is not limited by the above-described embodiments. For example, the configuration of the antenna device 1 is not limited to the above-described configuration.

Specifically, the arrangement of the antenna elements 11*a* is freely selected, and the antenna elements 11*a* may be arranged in a square pattern.

The moving object on which the antenna device 1 is mounted may be freely selected, and the moving object may be a vehicle, a ship, or the like. Also, the target of communication is not limited to the communication satellite, and the communication may be performed with a freely selected target, such as a communication device mounted on a vehicle or a communication device fixed on the ground. Further, either the position of the antenna device 1 or the position of the target may be fixed.

Figure 9:
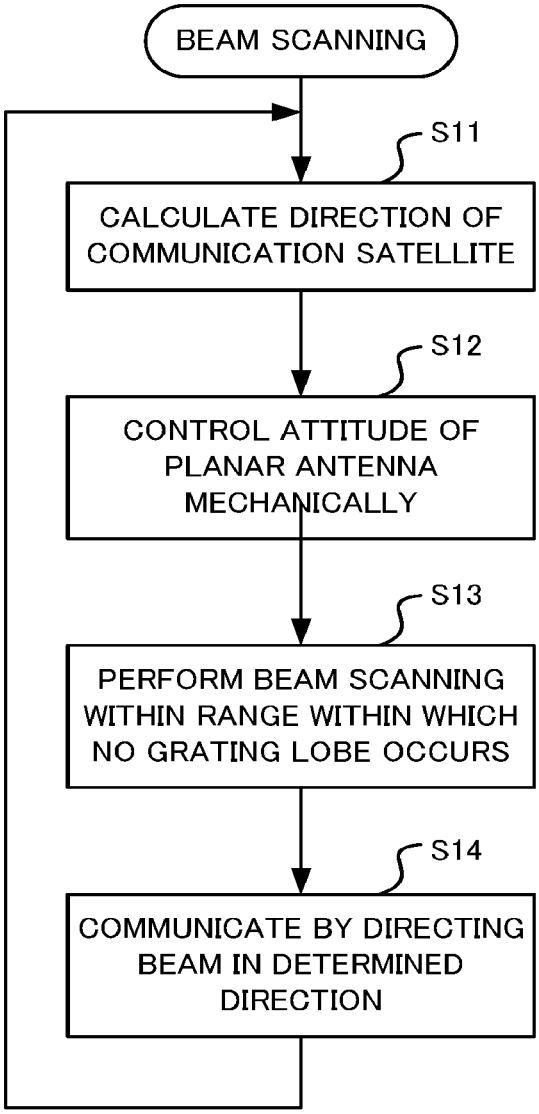
FIG. 9 is a flowchart illustrating an example of beam scanning processing performed by the antenna device according to Embodiment 1.

The above-described processing operation and communication operation are merely examples, and thus may be changed appropriately. For example, the order by which the processing in steps S11-S14 illustrated in FIG. 9 is executed may be changed appropriately. Specifically, the processing in steps S13 and S14 of FIG. 9 may be, after the processing in steps S11 and S12 is performed, repeatedly performed over a predetermined time period or repeatedly performed a predetermined number of times. The time period over which the processing in steps S13 and S14 is repeated and the number of times of repeating the processing in steps S13 and S14 may be freely determined in accordance with types of the target and the moving object, characteristics of the antenna device 1, or the like. Further, the processing may return to step S13 when the signal level of the reception signal decreases to equal to or lower than the threshold level in step S14, and the processing may return to step S11 when a beam direction at which signal strength of the reception signal exceeds a threshold value is not detected in step S13. Repeating the processing in steps S13 and S14 as described above changes the beam direction in accordance with change of the relative position of the target, and thus a small attitude control mechanism with low responsiveness can be used as the attitude controller 12.

Although a 2-axis gimbal mechanism is described as an example of the attitude controller 12, any mechanism that can change or control the attitude of the planar antenna 11 mechanically, that is, change or control orientation of the antenna face mechanically, such as a gimbal mechanism having the degree of freedom of three or more axes, may be employed.

Although directing the normal direction of the antenna face (that is, the Z' axis) toward the communication satellite is disclosed as an example of the function of the antenna controller 13, such configuration is not limiting. The antenna controller 13 may be configured to only control the attitude controller 12 such that the angle between the Z' axis and the line connecting the planar antenna 11 and the communication satellite becomes small.

The embodiments disclose, as an example of the function of the antenna controller 13, directing the normal direction of the antenna face (that is, the Z' axis) toward the communication satellite. This example is based on the premise that the beam direction with the excitation phase at the origin corresponds to the Z'-axis direction of the antenna 11. When employing a configuration in which the beam direction with the excitation phase at the origin is offset from the Z'-axis direction by a certain degree, the antenna controller 13 may control, in order to direct the beam with the excitation phase at the origin toward the communication satellite, the attitude controller 12 to direct the Z' axis in a direction that is offset from the direction of the communication satellite by the certain degree.

The scan controller 14 may adjust the excitation phases and excitation amplitudes of the antenna elements 11*a* using a variable phase shifter and an amplitude adjuster. In this case, the scan controller 14 includes an amplifier, a frequency convertor, and an analog to digital (A-D) convertor for each antenna element 11*a* and a digital signal processing circuit, and adjusts the excitation phases and the excitation amplitudes in the digital domain using the digital signal processing circuit.

Furthermore, the scan controller 14 may search for the direction of the communication satellite within the range of an attitude error that is a difference between the Z'-axis direction and the direction of the communication satellite and is caused by, for example, limitation to the driving range of the attitude controller 12, an error in mechanical structure, or an error in performing the control processing. In this case, the scan controller 14 may calculate a possible value of the attitude error by adding, to a difference between the direction of the communication satellite acquired from the target direction calculator 15 and the direction of the Z' axis acquired from the attitude controller 12, a possible error in the mechanical structure, and a possible error in performing the control processing, and then search for the direction of the communication satellite within the range of the attitude error.

Although the Z' axis is defined as the center of the scanning range, there is no need to set the Z' axis as the center of the scanning range. Further, the scan controller 14 may employ a lobe switching system to search for the direction of the communication satellite. The target direction calculator 15 may use, in order to calculate the direction of the communication satellite as viewed from the aircraft 2, positional information of the aircraft 2 based on at least one of a gyro sensor or a global positioning system (GPS).

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2018-80179, filed on Apr. 18, 2018, including the specification, claims, drawings, and abstract, the entire disclosure of which is incorporated by reference herein.

INDUSTRIAL APPLICABILITY

Reference Signs List

1 Antenna device
2 Aircraft
2*a* Outer surface
2*b* Concave portion
2*c* Bottom face
3 Communication device
4 External device
11 planar antenna
11*a* Antenna element
12 Attitude controller
13 Antenna controller
14 Scan controller
15 Target direction calculator
21 Processor
22 Memory
23 Interface
141 Phase shifter
142 Distribution/synthesis circuit

The invention claimed is:

1. An antenna device comprising:

a planar antenna including a plurality of antenna elements and configured to transmit and receive a radio wave to and from a target;

an attitude controller attached to the planar antenna and configured to control an attitude of the planar antenna mechanically;

an antenna controller to control the attitude controller such that the planar antenna points in a predetermined direction with respect to the target; and a scan controller to control beam scanning performed by the planar antenna and to adjust excitation phases of the plurality of antenna elements in accordance with a signal level of a reception signal generated from the radio wave received from the target during performance of the beam scanning, thereby directing a beam from the planar antenna toward the target, wherein the scan controller limits a range of the beam scanning to a range within which no grating lobe occurs, the range within which no grating lobe occurs being determined in accordance with a spacing between the plurality of antenna elements.

2. The antenna device according to claim 1 for mounting on a moving object, further comprising:

a target direction calculator to calculate, based on positional information of the target and positional information of the moving object, a direction of the target as viewed from the moving object, and the antenna controller controls the attitude controller in accordance with the direction of the target calculated by the target direction calculator.

3. The antenna device according to claim 2, wherein the antenna device is disposed in a concave portion formed in an outer surface of the moving object, and the antenna controller controls the attitude controller to radiate beams from the plurality of antenna elements to an exterior of the moving object such that the beams pass through positions located away from an edge of the concave portion.

4. The antenna device according to claim 3, wherein the scan controller performs the beam scanning within a range of an attitude error that is a difference between the direction in which the planar antenna points and the direction of the target.

5. The antenna device according to claim 2, wherein the scan controller performs the beam scanning within a range of an attitude error that is a difference between the direction in which the planar antenna points and the direction of the target.

6. The antenna device according to claim 1, wherein the scan controller performs the beam scanning within a range of an attitude error that is a difference between the direction in which the planar antenna points and the direction of the target.

7. An antenna control method comprising:

controlling an attitude of a planar antenna such that the planar antenna points in a predetermined direction with respect to a target, the planar antenna including a plurality of antenna elements and being configured to transmit and receive a radio wave to and from the target;

controlling beam scanning performed by the planar antenna and adjusting excitation phases of the plurality of antenna elements in accordance with a signal level of a reception signal generated from the radio wave received from the target during performance of the beam scanning, thereby directing a beam from the planar antenna toward the target, and limiting a range of the beam scanning to a range within which no grating lobe occurs, the range within which no grating lobe occurs being determined in accordance with a spacing between the plurality of antenna elements.

8. A non-transitory computer readable recording medium storing a program for causing a computer to function as:

an antenna controller to control an attitude of a planar antenna such that the planar antenna points in a predetermined direction with respect to a target, the planar antenna including a plurality of antenna elements and being configured to transmit and receive a radio wave to and from the target; and a scan controller to control beam scanning performed by the planar antenna and to adjust excitation phases of the plurality of antenna elements in accordance with a signal level of a reception signal generated from the radio wave received from the target during performance of the beam scanning, thereby directing a beam from the planar antenna toward the target, wherein a range of the beam scanning is limited to a range within which no grating lobe occurs, the range within which no grating lobe occurs being determined in accordance with a spacing between the plurality of antenna elements.

* * * * *